US009380398B2

(12) United States Patent
Mitsufuji

(10) Patent No.: US 9,380,398 B2
(45) Date of Patent: Jun. 28, 2016

(54) SOUND PROCESSING APPARATUS, METHOD, AND PROGRAM

(71) Applicant: Sony Corporation, Tokyo (JP)

(72) Inventor: Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 163 days.

(21) Appl. No.: 14/249,780

(22) Filed: Apr. 10, 2014

(65) Prior Publication Data

US 2014/0321653 A1 Oct. 30, 2014

(30) Foreign Application Priority Data

Apr. 25, 2013 (JP) ..... 2013-092748

(51) Int. Cl.

| | |
|---|---|
| ***H04R 5/00*** | (2006.01) |
| ***H04S 3/02*** | (2006.01) |
| ***H04R 3/00*** | (2006.01) |
| *H04S 3/00* | (2006.01) |

(52) U.S. Cl.

CPC *H04S 3/02* (2013.01); *H04R 3/005* (2013.01); *H04R 2499/13* (2013.01); *H04S 3/008* (2013.01); *H04S 2400/15* (2013.01)

(58) Field of Classification Search

None

See application file for complete search history.

(56) References Cited

U.S. PATENT DOCUMENTS

| | | | | |
|---|---|---|---|---|
| 2005/0222840 | A1* | 10/2005 | Smaragdis | 704/204 |
| 2007/0110203 | A1* | 5/2007 | Mizutani | 375/355 |
| 2012/0203719 | A1* | 8/2012 | Mitsufuji et al. | 706/12 |
| 2014/0133674 | A1* | 5/2014 | Mitsufuji et al. | 381/92 |
| 2015/0304766 | A1* | 10/2015 | Delikaris-Manias et al. | 1/32 |

FOREIGN PATENT DOCUMENTS

| | | | |
|---|---|---|---|
| JP | 2012-238964 | A | 6/2012 |
| JP | 2012-205161 | A | 10/2012 |

OTHER PUBLICATIONS

Sawada et al. (Multichannel Extensions of Non-Negative Matrix Factorization With Complex-Valued Data, IEEE Transactions on Audio, Speech, and Language Processing, vol. 21, No. 5, May 2013).*

* cited by examiner

*Primary Examiner* — Regina N Holder

(74) *Attorney, Agent, or Firm* — Wolf, Greenfield & Sacks, P.C.

(57) ABSTRACT

Disclosed is a sound processing apparatus including a factorization unit and an extraction unit. The factorization unit is configured to factorize frequency information obtained by performing time-frequency transformation on sound signals of a plurality of channels into a channel matrix expressing properties in a channel direction, a frequency matrix expressing properties in a frequency direction, and a time matrix expressing properties in a time direction. The extraction unit is configured to compare the channel matrix with a threshold and extract components specified by a result of the comparison from the channel matrix, the frequency matrix, and the time matrix to generate the frequency information on a sound from a desired sound source.

12 Claims, 8 Drawing Sheets

SOUND PROCESSING APPARATUS, METHOD, AND PROGRAM

CROSS REFERENCE TO RELATED APPLICATIONS

This application claims the benefit of Japanese Priority Patent Application JP2013-092748 filed Apr. 25, 2013, the entire contents of which are incorporated herein by reference.

BACKGROUND

The present technology relates to a sound processing apparatus, a method, and a program and, in particular, to a sound processing apparatus, a method, and a program capable of performing sound source separation more easily and reliably.

Known technologies separate sounds output from a plurality of sound sources into the sounds of the respective sound sources.

For example, as an element technology for establishing both the transmission of realistic sensations and the enhancement of the sound clearness of a sound communication device, a background sound separator has been proposed (see, for example, Japanese Patent Application Laid-open No. 2012-205161). The background sound separator estimates steady background sounds using minimum value detection, the averages of spectrums only in background sound intervals, or the like.

In addition, as a sound source separation technology, a sound separation device capable of properly separating sounds from adjacent sound sources and sounds from distant sound sources from each other has been proposed (see, for example, Japanese Patent Application Laid-open No. 2012-238964). The sound separation device uses two microphones, i.e., an adjacent sound source microphone (NFM) and a distant sound source microphone (FFM) to perform sound source separation by independent component analysis.

SUMMARY

Meanwhile, there has been a demand that, when low sounds (hereinafter also called local sounds) near microphones and loud sounds (hereinafter also called global sounds) distant from the microphones are simultaneously input, the local sounds and the global sounds be distinguished and separated from each other.

However, the above technologies have difficulty in performing sound source separation easily and reliably, for example, when separating local sounds and global sounds from each other.

For example, background sounds generally contain not only steady components but also many unsteady components such as conversation sounds and hissing sounds as local sounds. Therefore, the background sound separator described in Japanese Patent Application Laid-open No. 2012-205161 has difficulty in removing unsteady components.

In addition, it is theoretically difficult to separate sound sources greater in number than the number of microphones by the independent component analysis. Specifically, it is possible to separate sounds into the two sound sources of global sounds and local sounds with the use of the two microphones in the related art, but it is difficult to separate the local sounds from each other and separate the sounds into three sound sources in total. Accordingly, for example, it is difficult to absorb local sounds near specific microphones.

Moreover, since the sound separation device described in Japanese Patent Application Laid-open No. 2012-238964 desirably uses the two types of special microphones (FFM and NFM), the number and the types of the microphones are limited and the sound source separation device is used only for limited purposes.

The present technology has been made in view of the above circumstances and it is therefore desirable to perform sound source separation more easily and reliably.

A sound processing apparatus according to an embodiment of the present technology includes a factorization unit and an extraction unit. The factorization unit is configured to factorize frequency information obtained by performing time-frequency transformation on sound signals of a plurality of channels into a channel matrix expressing properties in a channel direction, a frequency matrix expressing properties in a frequency direction, and a time matrix expressing properties in a time direction. The extraction unit is configured to compare the channel matrix with a threshold and extract components specified by a result of the comparison from the channel matrix, the frequency matrix, and the time matrix to generate the frequency information on a sound from a desired sound source.

The extraction unit may generate the frequency information on the sound from the sound source based on the frequency information obtained by the time-frequency transformation, the channel matrix, the frequency matrix, and the time matrix.

The threshold may be set based on a relationship between a position of the sound source and a position of a sound collection unit configured to collect sounds of the sound signals of the respective channels.

The threshold may be set for each of the channels.

The sound processing apparatus may further include a signal synchronization unit configured to bring signals of a plurality of sounds collected by different devices into synchronization with each other to generate the sound signals of the plurality of channels.

The factorization unit may assume the frequency information as a three-dimensional tensor with a channel, a frequency, and a time frame as respective dimensions to factorize the frequency information into the channel matrix, the frequency matrix, and the time matrix by tensor factorization.

The tensor factorization may be non-negative tensor factorization.

The sound processing apparatus may further include a frequency-time transformation unit configured to perform frequency-time transformation on the frequency information on the sound from the sound source obtained by the extraction unit to generate a sound signal of the plurality of channels.

The extraction unit may generate the frequency information containing sound components from one of the desired sound source and a plurality of the desired sound sources.

A sound processing method or a program according to an embodiment of the present technology includes: factorizing frequency information obtained by performing time-frequency transformation on sound signals of a plurality of channels into a channel matrix expressing properties in a channel direction, a frequency matrix expressing properties in a frequency direction, and a time matrix expressing properties in a time direction; and comparing the channel matrix with a threshold and extracting components specified by a result of the comparison from the channel matrix, the frequency matrix, and the time matrix to generate the frequency information on a sound from a desired sound source.

According to an embodiment of the present technology, frequency information obtained by performing time-frequency transformation on sound signals of a plurality of channels is factorized into a channel matrix expressing properties in a channel direction, a frequency matrix expressing properties in a frequency direction, and a time matrix expressing properties in a time direction. In addition, the channel matrix is compared with a threshold, and components specified by a result of the comparison are extracted from the channel matrix, the frequency matrix, and the time matrix to generate the frequency information on a sound from a desired sound source.

According to an embodiment of the present technology, it is possible to perform sound source separation more easily and reliably.

These and other objects, features and advantages of the present disclosure will become more apparent in light of the following detailed description of best mode embodiments thereof, as illustrated in the accompanying drawings.

DETAILED DESCRIPTION OF EMBODIMENTS

Figure 1:
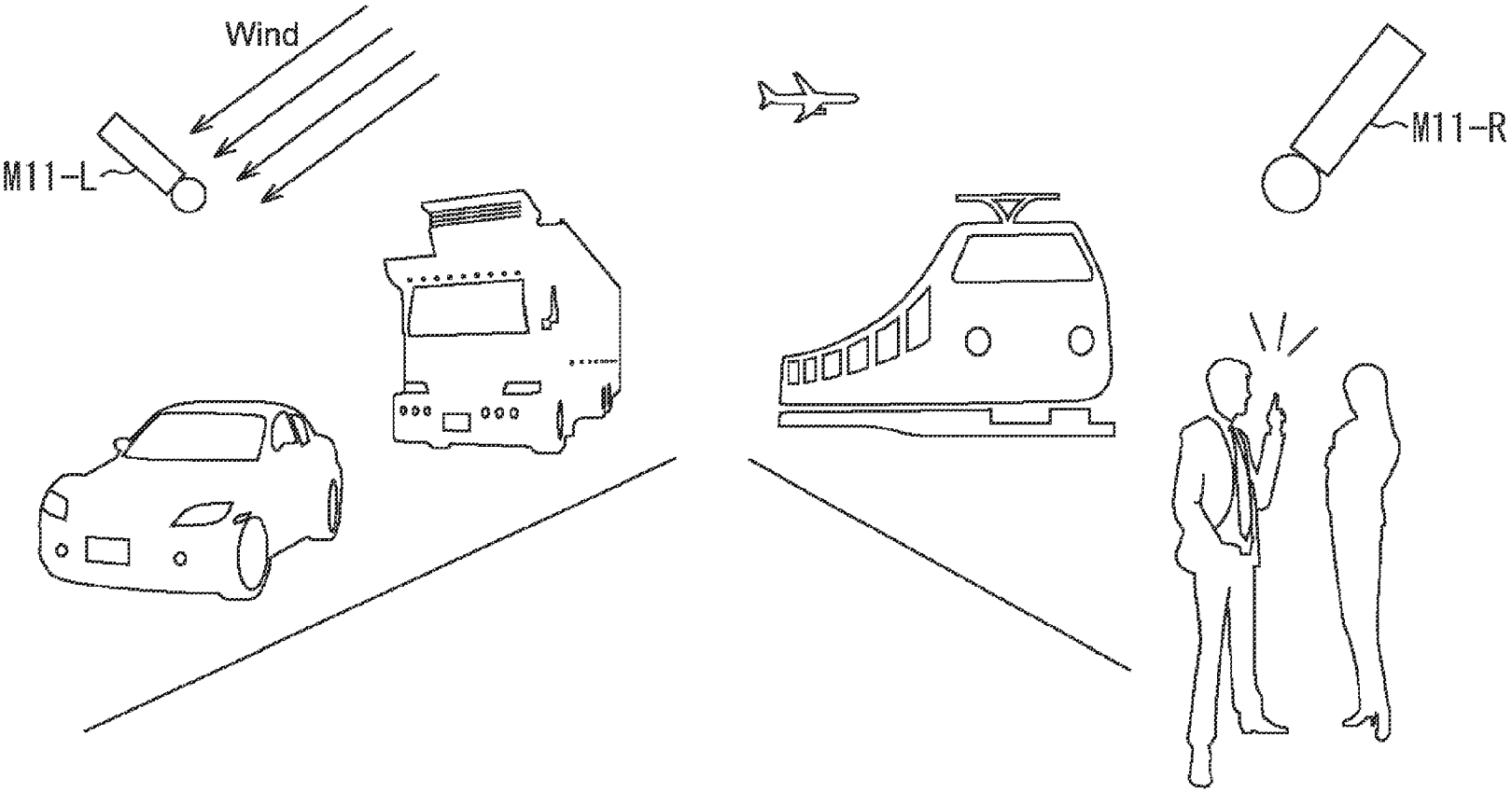
FIG. 1 is a diagram describing the collection of a sound by a microphone.

Hereinafter, a description will be given of an embodiment to which the present technology is applied with reference to the drawings.

(Outline of Present Technology)

First, the outline of the present technology will be described.

For example, when information is recorded using a microphone in the real world, an input signal is rarely a signal emitted from a single sound source but is generally a signal in which signals emitted from a plurality of sound sources are mixed together.

In addition, the distance between each sound source group and a microphone is different. Even if the sound pressure of each sound source signal is evenly perceived when a mixed sound is listened, the sound source of each sound source signal is not necessarily separated from the microphone at an equal distance. When each sound source group is roughly classified into two groups based on the distance, one group is a signal group that has a relatively high initial sound pressure but has a large sound pressure attenuation and the other group is a signal group that has a relatively low initial sound pressure but has a small sound pressure attenuation.

As described above, the signal that has a relatively high initial sound pressure but has a large sound pressure attenuation is the sound signal of a global sound, i.e., a loud sound emitted from a sound source distant from a microphone. On the other hand, the signal that has a relatively low initial sound pressure but has a small sound pressure attenuation is the sound signal of a local sound, i.e., a low sound emitted from a sound source near the microphone.

It is really difficult to separate a global sound from a local sound when a signal recorded by a microphone has only one dimension. However, when a plurality of microphones exist in the same space, it is possible to separate a global sound from a local sound based on the component ratio of each sound source signal contained in the input signal of each microphone.

In the present technology, a sound pressure ratio is used as a component ratio. For example, when the sound pressure ratio of a sound from a specific sound source A is large only in a specific microphone M1, it is assumable that the sound source A exists near the microphone M1.

On the other hand, when a signal is input from a specific sound source B with a sound pressure ratio even to all the microphones, it is assumable that the sound source B with high sound pressure remotely exists.

The above assumption is made provided that a group of the microphones are arranged with a certain distance. By separating the signals from each other for each sound source and classifying them based on the sound pressure ratio of each separated signal, it is possible to separate a global sound from a local sound.

Here, the above assumption is rebutted in a case in which a plurality of sound sources with the same types of sound characteristics may exist near each microphone, but such a case rarely occurs in the real world.

In the real world, examples of a global sound include the sounds of signals with relatively high sound pressure such as sounds emitted from transport facilities, sounds emitted from construction sites, cheers from stadiums, and orchestra performance. On the other hand, examples of a local sound include the sounds of signals with relatively low sound pressure such as conversation sounds, sounds of footsteps, and hissing sounds.

The present technology is applicable to, for example, realistic sensations communication or the like. The realistic sensations communication is technology for transmitting input signals from a plurality of microphones installed in towns to remote places. On this occasion, the microphones are not necessarily fixed in places and are assumed to include those installed in mobile devices possessed by moving persons or the like.

Sound signals acquired by a plurality of microphones are subjected to signal processing in the present technology, and collected sounds are classified into global sounds and local sounds. As a result, various secondary effects are obtained.

For easy understanding, a description will be given, as an example, of a town image offering service by which a desired place on a map is designated to display an image of a town shot at the place. In the town image offering service, an image of a town changes as a user moves a place on a map. Therefore, the user may enjoy seeing the map with a feeling as if he/she was in an actual place.

Presently, general town image offering services transmit only still images. However, when it is assumed to develop the offering of moving images, various problems arise. For example, the problems include a problem as to how moving images acquired by a plurality of cameras are integrated together and a problem as to whether privacy on the sounds of persons contained in the sounds of moving images is protected.

As a countermeasure for the former problem, it is assumed that local sounds near each microphone are not used and global sounds with greater realistic sensations are used as integrated sounds. In addition, as a countermeasure for the latter problem, it is assumed that local sounds containing the sounds of persons are deleted and reduced or voice quality is transformed.

(Configuration Example of Global Sound Extraction Apparatus)

Next, a description will be given of a specific embodiment to which the present technology is applied. Hereinafter, using a global sound extraction apparatus as an example, a description will be given of a global sound/local sound separation apparatus to which the present technology is applied. Note that although the global sound/local sound separation apparatus is, of course, capable of extracting only the sound signal of a specific local sound from among sounds collected by microphones, the following description will be given of a case in which only a global sound is extracted as an example.

The global sound extraction apparatus is an apparatus that, in a case in which sounds are recorded by a plurality of microphones, separates and removes a local signal existing in only a sound collected by each of the microphones, i.e., only the sound signal of a local sound, and acquires a global signal, i.e., only the sound signal of a global sound.

Here, FIG. 1 shows an example in which signals are recorded by two microphones. In FIG. 1, sounds are collected by a microphone M11-L positioned on a left back side and a microphone M11-R provided on a right near side. Note that when the microphones M11-L and M11-R are not particularly distinguished from each other, they are also merely called microphones M11.

In the example of FIG. 1, the microphones M11 are installed under an outside environment in which automobiles and a train run and persons exist. Further, hissing sounds are mixed in only sounds collected by the microphone M11-L, while conversation sounds by the persons are mixed in only sounds collected by the microphone M11-R.

The global sound extraction apparatus performs signal processing with sound signals acquired by the microphones M11-L and M11-R as input signals to separate global sounds from local sounds.

Here, the global sounds are the sounds of signals input to both the microphones M11-L and M11-R, and the local sounds are the sounds of signals input to one of the microphones M11-L and M11-R.

In the example of FIG. 1, the hissing sounds and the conversation sounds are the local sounds, and the other sounds are the global sounds. Note that although the two microphones M11 in total are used in the example of FIG. 1 to make the description simple, two or more microphones may actually exist. In addition, the types, directional characteristics, arrangement directions, or the like of the microphones M11 are not particularly limited.

Further, as an applied example of the present technology, the above description is given of the case in which the plurality of microphones M11 are installed outside and the global sounds are separated from the local sounds. However, the present technology is also applicable to, for example, multi-view recording. The multi-view recording is an application program that extracts only an element common to a plurality of sound signals acquired together with an image and reproduces the same in connection with the image in a situation in which many audiences upload moving images at, for example, a football stadium and enjoy the same image with multi-views on the Internet.

As described above, by extracting only a common element, it is possible to prevent conversation sounds by each person or surrounding persons and local noises from being mixed.

Figure 2:
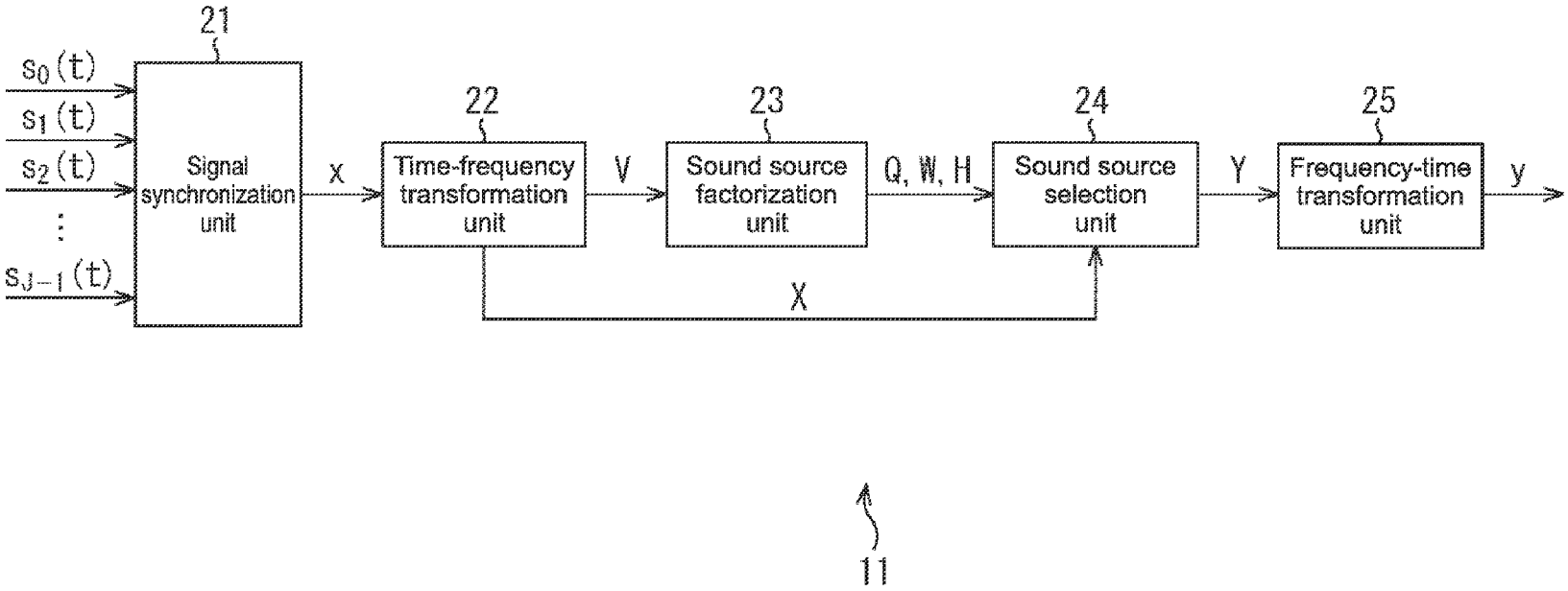
FIG. 2 is a diagram showing a configuration example of a global sound extraction apparatus.

Next, a description will be given of a specific configuration example of the global sound extraction apparatus. FIG. 2 is a diagram showing a configuration example of an embodiment of the global sound extraction apparatus to which the present technology is applied.

The global sound extraction apparatus 11 includes a signal synchronization unit 21, a time-frequency transformation unit 22, a sound source factorization unit 23, a sound source selection unit 24, and a frequency-time transformation unit 25.

A plurality of sound signals collected by a plurality of microphones M11 installed in different devices are supplied to the signal synchronization unit 21 as input signals. The signal synchronization unit 21 brings the asynchronous input signals supplied from the microphones M11 into synchronization with each other and then arranges the respective input signals in a plurality of respective channels to generate a pseudo-multichannel input signal and supplies the same to the time-frequency transformation unit 22.

The respective input signals supplied to the signal synchronization unit 21 are the signals of sounds collected by the microphones M11 installed in the different devices and thus are not synchronized with each other. Therefore, the signal synchronization unit 21 brings the asynchronous input signals into synchronization with each other and then treats the respective synchronized input signals as the sound signals of the respective channels to generate the pseudo-multichannel input signal including the plurality of channels.

Note that although the description is given of a case in which the respective input signals supplied to the signal synchronization unit 21 are not synchronized with each other, respective input signals supplied to the global sound extraction apparatus 11 may be synchronized with each other. For example, a sound signal acquired by a microphone for a right channel installed in a device and a sound signal acquired by a microphone for a left channel installed in the device may be supplied to the global sound extraction apparatus 11 as input signals.

In this case, since the input signals of the right and left channels are synchronized with each other, the global sound extraction apparatus 11 may not have the signal synchronization unit 21 and the synchronized input signals are supplied to the time-frequency transformation unit 22.

The time-frequency transformation unit 22 performs time-frequency transformation on the pseudo-multichannel input signal supplied from the signal synchronization unit 21 and makes the same non-negative.

That is, the time-frequency transformation unit 22 performs the time-frequency transformation on the supplied pseudo-multichannel input signal and supplies resulting input complex spectrums as frequency information to the sound source selection unit 24. In addition, the time-frequency transformation unit 22 supplies a non-negative spectrogram including non-negative spectrums obtained by making the input complex spectrums non-negative to the sound source factorization unit 23.

The sound source factorization unit 23 assumes the non-negative spectrogram supplied from the time-frequency transformation unit 22 as a three-dimensional tensor with a channel, a frequency, and a time frame as dimensions and performs NTF (Non-negative Tensor Factorization). The sound source factorization unit 23 supplies a channel matrix Q, a frequency matrix W, and a time matrix H obtained by the NTF to the sound source selection unit 24.

The sound source selection unit 24 selects the components of the respective matrices corresponding to a global sound based on the channel matrix Q, the frequency matrix W, and the time matrix H supplied from the sound source factorization unit 23 and resynthesizes a spectrogram including the input complex spectrums supplied from the time-frequency transformation unit 22. The sound source selection unit 24 supplies an output complex spectrogram Y as frequency information obtained by the resynthesis to the frequency-time transformation unit 25.

The frequency-time transformation unit 25 performs frequency-time transformation on the output complex spectrogram Y supplied from the sound source selection unit 24 and then performs the overlap addition of a resulting time signal to generate and output the multichannel output signal of the global sound.

(Signal Synchronization Unit)

Next, a description will be given in more detail of the respective units of the global sound extraction apparatus 11 in FIG. 2. First, the signal synchronization unit 21 will be described.

The signal synchronization unit 21 establishes the time synchronization of input signals $S_j(t)$ supplied from a plurality of microphones M11. For example, the calculation of a cross correlation is used to establish the time synchronization.

Here, j in the input signals $S_j(t)$ expresses a channel index and is expressed by $0 \le j \le J-1$. In addition, J expresses the total number of the channels of a pseudo-multichannel input signal. Moreover, t in the input signals $S_j(t)$ expresses time.

When it is assumed that a reference input signal $S_0(t)$ among the input signals $S_j(t)$ is an input signal as a synchronization reference and a target input signal $S_j(t)$ among the input signals $S_j(t)$ is an input signal as a synchronization target (where $j \neq 0$), the cross correlation value $R_j(\gamma)$ of a channel j is calculated by the following formula (1).

$$R_j(\gamma) = \frac{1}{T_{all}} \sum_{t}^{T_{all}-\gamma-1} s_0(t) \cdot s_j(t+\gamma) \quad (1)$$

$$\gamma = 0, 1, \ldots T_{all} - 1$$

Note that $T_{all}$ in the above formula (1) expresses the number of the samples of the input signals $S_j(t)$, and the number of the samples $T_{all}$ of the input signals $S_j(t)$ supplied from the plurality of respective microphones M11 are all the same. In addition, γ in the above formula (1) expresses a lag.

The signal synchronization unit 21 calculates the following formula (2) based on the cross correlation value $R_j(\gamma)$ found for the value of each lag γ to find a maximum value lag $\gamma_j$ as a lag value when the cross correlation value $R_j(\gamma)$ indicates the maximum value of the lag γ in the target input signal $S_j(t)$.

$$\gamma_j = \underset{\gamma}{\operatorname{argmax}} R_j(\gamma) \quad (2)$$

Then, by calculating the following formula (3), the signal synchronization unit 21 corrects the samples by the maximum value lag $\gamma_j$ to bring the target input signal $S_j(t)$ into synchronization with the reference input signal $S_0(t)$. That is, the target input signal $S_j(t)$ is shifted in a time direction by the number of the samples of the maximum value lag $\gamma_j$ to generate a pseudo-multichannel input signal x(j, t).

$$x(j,t) = s_j(t+\gamma_j) \quad (3)$$

Here, the pseudo-multichannel input signal x(j, t) expresses the signal of the channel j of the pseudo-multichannel input signal including J channel signals. In addition, in the pseudo-multichannel input signal x(j, t), j expresses a channel index, and t expresses time.

The signal synchronization unit 21 supplies the pseudo-multichannel signal x(j, t) thus obtained to the time-frequency transformation unit 22.

(Time-Frequency Transformation Unit)

Next, the time-frequency transformation unit 22 will be described.

The time-frequency transformation unit 22 analyzes time-frequency information on the pseudo-multichannel input signal x(j, t) supplied from the signal synchronization unit 21.

That is, the time-frequency transformation unit 22 performs time frame division on the pseudo-multichannel input signal x(j, t) at a fixed size to obtain a pseudo-multichannel input frame signal x'(j, n, l).

Here, in the pseudo-multichannel input frame signal x'(j, n, l), j expresses a channel index, n expresses a time index, and l expresses a time frame index.

The time-frequency transformation unit 22 multiplies the obtained pseudo-multichannel input frame signal x'(j, n, l) by a window function $W_{ana}(n)$ to obtain a window function applied signal $x_w(j, n, l)$.

Note, however, that the channel index j is 0, . . . , J−1, the time index n is 0, . . . , N−1, and the time frame index l is 0, . . . , L−1. J expresses the total number of channels, N expresses a frame size, i.e., the number of the samples of a time frame, and L expresses the total number of frames.

Specifically, the time-frequency transformation unit 22 calculates the following formula (4) to obtain the window function applied signal $x_w(j, n, l)$ from the pseudo-multichannel input frame signal x'(j, n, l).

$$x_w(j,n,l) = w_{ana}(n) \times x'(j,n,l) \quad (4)$$

In addition, as the window function $W_{ana}(n)$ used in the calculation of formula (4), a function indicated by the following formula (5) or the like is used.

$$w_{ana}(n) = \left(0.5 - 0.5 \times \cos\left(2\pi \frac{n}{N}\right)\right)^{0.5} \quad (5)$$

Note here that although the window function $W_{ana}(n)$ is the square root of a Hanning window, other windows such as a hamming window and a Blackman-Harris window may be used.

In addition, although the frame size N expresses the number of samples corresponding to one frame time fsec in a sampling frequency $f_s$, i.e., N=R ($f_s$×fsec) or the like, it may have other sizes.

Note that R( ) expresses any round-up function and is, for example, a half-adjust or the like here. In addition, the one frame time fsec is, for example, 0.02 (s) or the like. Moreover, the shift amount of a frame is not limited to 50% of the frame size N but may have any value.

When the window function applied signal $x_w(j, n, l)$ is thus obtained, the time-frequency transformation unit 22 performs time-frequency transformation on the window function applied signal $x_w(j, n, l)$ to obtain an input complex spectrum X(j, k, l) as frequency information. That is, the following formula (6) is calculated to obtain the input complex spectrum X(j, k, l) by DFT (Discrete Fourier Transform).

$$X(j, k, l) = \sum_{m=0}^{M-1} x'_w(j, m, l) \times \exp \quad (6)$$

Note that in the above formula (6), i expresses a pure imaginary number, and M expresses the number of points used for the time-frequency transformation. For example, although the number of points M is greater than or equal to the frame size N and set at a value that is a power of two closest to N, it may be set at other numbers.

In addition, in the above formula (6), k expresses a frequency index for specifying a frequency, and the frequency index k is 0, . . . , K−1. Note that K=M/2+1 is established.

Moreover, in the above formula (6), $x_w'(j, m, l)$ is a zero padding signal and expressed by the following formula (7). That is, in the time-frequency transformation, zero is padded depending on the number of the points M of the DFT.

$$x_w'(j, m, l) = \begin{cases} x_w(j, m, l) & m = 0, \ldots, N-1 \\ 0 & m = N, \ldots, M-1 \end{cases} \quad (7)$$

Note that although a description here is given of a case in which the time-frequency transformation is performed by the DFT, DCT (Discrete Cosine Transform) or MDCT (Modified Discrete Cosine Transform) may be used to perform the time-frequency transformation.

The time-frequency transformation unit 22 performs the time-frequency transformation for each time frame of the pseudo-multichannel input signal, and joins together, when calculating the input complex spectrums X(j, k, l), the input complex spectrums X(j, k, l) crossing the plurality of the frames of the same channel to constitute a matrix.

Figure 3:
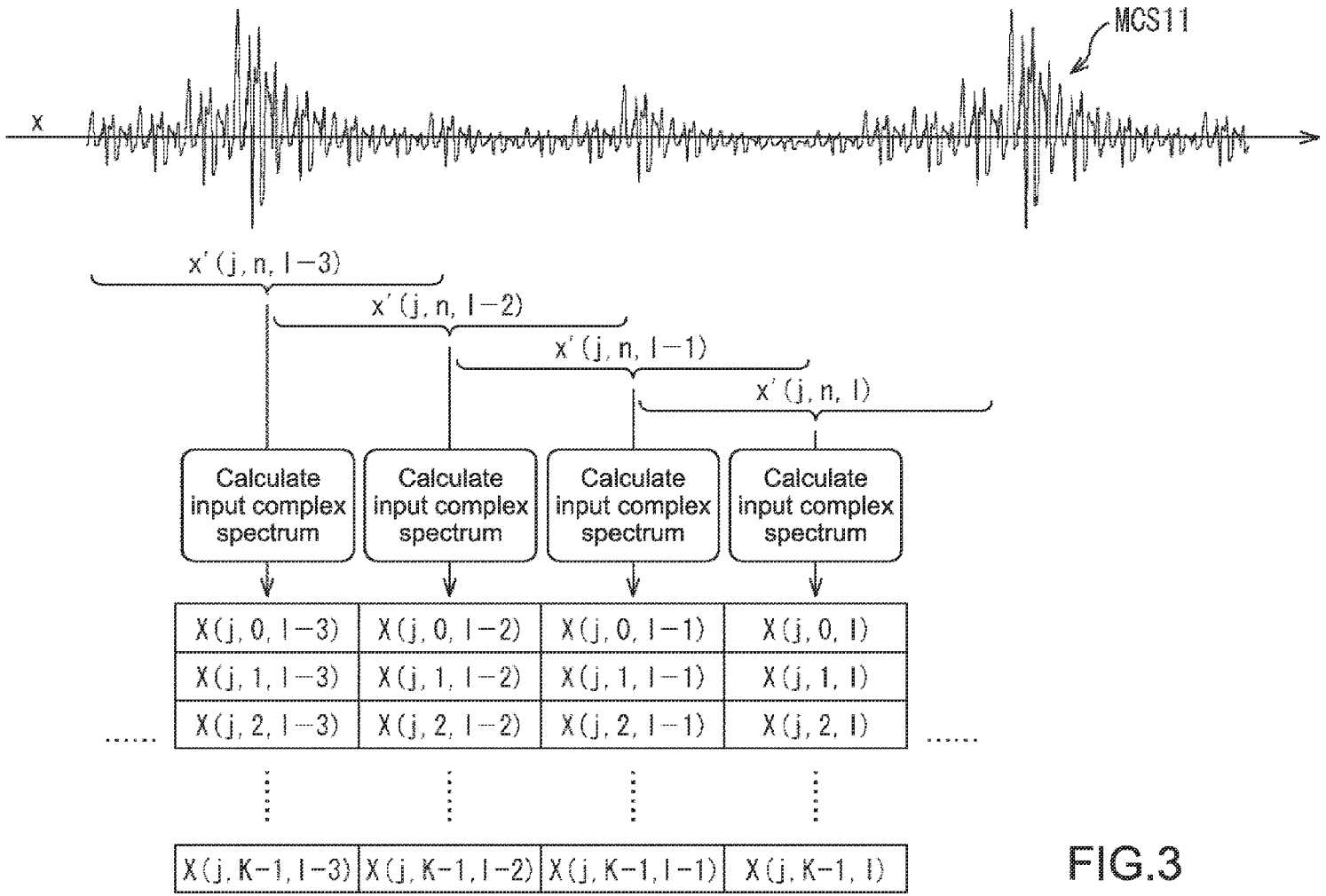
FIG. 3 is a diagram describing input complex spectrums.

Thus, for example, a matrix shown in FIG. 3 is obtained. In FIG. 3, the frequency-time transformation unit 22 performs the time-frequency transformation on the four adjacent pseudo-multichannel input frame signals x'(j, n, l−3) to x'(j, n, l) of the pseudo-multichannel input signal x(j, t) for one channel indicated by an arrow MSC11.

Note that the vertical direction and the horizontal direction of the pseudo-multichannel input signal x(j, t) indicated by the arrow MCS11 express an amplitude and time, respectively.

In FIG. 3, one rectangle expresses one input complex spectrum. For example, when the time-frequency transformation unit 22 performs the time-frequency transformation on the pseudo-multichannel input frame signal x'(j, n, l−3), K input complex spectrums x'(j, n, l−3) to X(j, K−1, l−3) are obtained.

When the input complex spectrums are thus obtained for the respective time frames, they are joined together to constitute one matrix. Then, when matrices obtained for the respective J channels are further joined together in a channel direction, an input complex spectrogram X shown in FIG. 4 is obtained.

Figure 4:
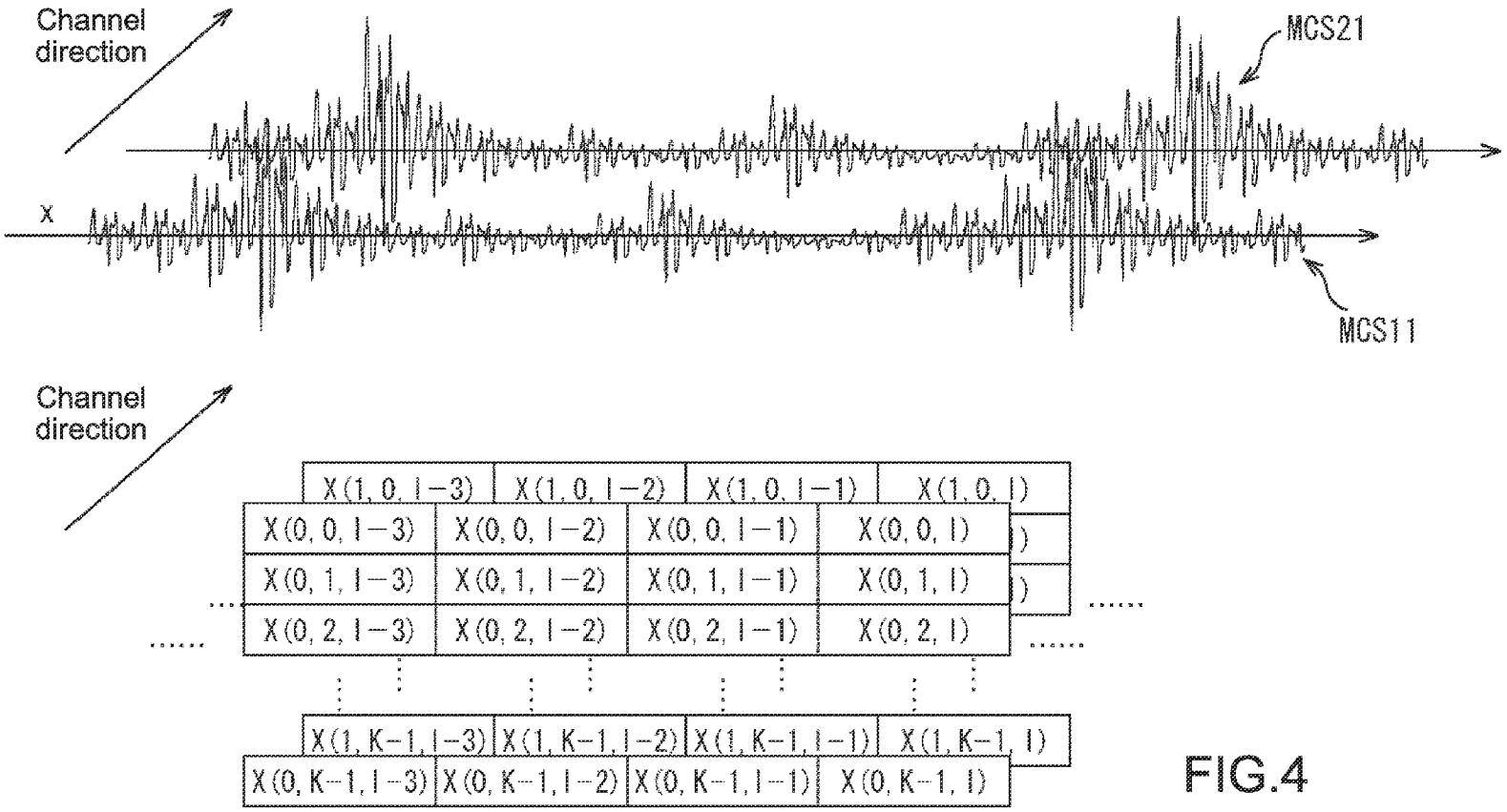
FIG. 4 is a diagram describing an input complex spectrogram.

Note that in FIG. 4, parts corresponding to those in FIG. 3 are denoted by the same symbols and their descriptions will be omitted.

In FIG. 4, the pseudo-multichannel input signal x(j, t) indicated by an arrow MCS21 expresses a pseudo-multichannel input signal with channels different from those of the pseudo-multichannel input signal x(j, t) indicated by the arrow MCS11, and the total number J of the channels is two in this example.

In addition, in FIG. 4, one rectangle expresses one input complex spectrum, and the respective input complex spectrums are arranged and joined together in a vertical direction, a horizontal direction, and a depth direction, i.e., in a frequency direction, a time direction, and a channel direction to constitute an input complex spectrogram X expressed by a three-dimensional tensor.

Note that when the respective elements of the input complex spectrogram X are indicated in the following description, they will be expressed as $[X]_{jkl}$ or $x_{jkl}$.

In addition, the time-frequency transformation unit 22 calculates the following formula (8) to make the respective input complex spectrums X(j, k, l) obtained by the time-frequency transformation non-negative to calculate non-negative spectrums V(j, k, l).

$$V(j,k,l)=(X(j,k,l)\times \mathrm{conj}(X(j,k,l)))^{\rho} \quad (8)$$

Note that in the above formula (8), conj(X(j, k, l)) expresses the complex conjugate of the input complex spectrums X(j, k, l), and ρ expresses a non-negative control value. For example, although the non-negative control value ρ may have any value, the non-negative spectrums become power spectrums when ρ=1 and become amplitude spectrums when ρ=0.5.

The non-negative spectrums V(j, k, l) obtained by the calculation of the above formula (8) are joined together in the channel direction, the frequency direction, and the time frame direction to constitute a non-negative spectrogram V, and the non-negative spectrogram V is supplied from the time-frequency transformation unit 22 to the sound source factorization unit 23.

In addition, the time-frequency transformation unit 22 supplies the respective input complex spectrums X(j, k, l), i.e., the input complex spectrogram X to the sound source selection unit 24.

(Sound Source Factorization Unit)

Next, the sound source factorization unit 23 will be described.

The sound source factorization unit 23 assumes the non-negative spectrogram V as a three-dimensional tensor of J×K×L and separates the same into P three-dimensional tensors $V_p'$ (hereinafter also called a base spectrogram). Here, p expresses a base index indicating the base spectrogram, and the number of bases P is 0, . . . , P−1. In addition, in the following description, the base indicated by the base index p will also be called the base p.

Moreover, since the P three-dimensional tensors $V_p'$ may be expressed by a direct product of three vectors, they are each factorized into three vectors. As a result, since P sets of the three types of vectors are collected to obtain three new matrices, i.e., a channel matrix Q, a frequency matrix W, and a time matrix H, the non-negative spectrogram V may be factorized into the three matrices. Note that the size of the channel matrix Q is expressed by J×P, the size of the frequency matrix W is expressed by K×P, and the size of the time matrix H is expressed by L×P.

Note that when the three-dimensional tensors or the respective elements of the matrices are expressed in the following description, they will be expressed as $[V]_{jkl}$ or $v_{jkl}$. In addition, when a specific dimension is specified and all the elements of the remaining dimensions are expressed, ":" is used as an expression and $[V]_{:,k,l}$, $[V]_{j,:,l}$, and $[V]_{j,k,:}$ are expressed depending on the dimensions.

In this example, $[V]_{jkl}$, $V_{jkl}$, $[V]_{:,k,l}$, $[V]_{j,:,l}$, and $[V]_{j,k,:}$ express the elements of the non-negative spectrogram V. For example, $[V]_{j,:,:}$ is an element that constitutes the non-negative spectrogram V and has a channel index of j.

The sound source factorization unit 23 minimizes an error tensor E by non-negative tensor factorization to perform tensor factorization. Restrictions for optimization include making the non-negative spectrogram V, the channel matrix Q, the frequency matrix W, and the time matrix H non-negative.

Due to the restrictions, it has been known that properties unique to a sound source are capable of being extracted by the non-negative tensor factorization unlike tensor factorization methods in the related art such as PARAFAC and Tucker factorization. In addition, it has been known that the non-negative tensor factorization is the generalization of NMF (Non-negative Matrix Factorization) to a tensor.

The channel matrix Q, the frequency matrix W, and the time matrix H obtained by the tensor factorization have their unique properties.

Here, the channel matrix Q, the frequency matrix W, and the time matrix H will be described.

Figure 5:
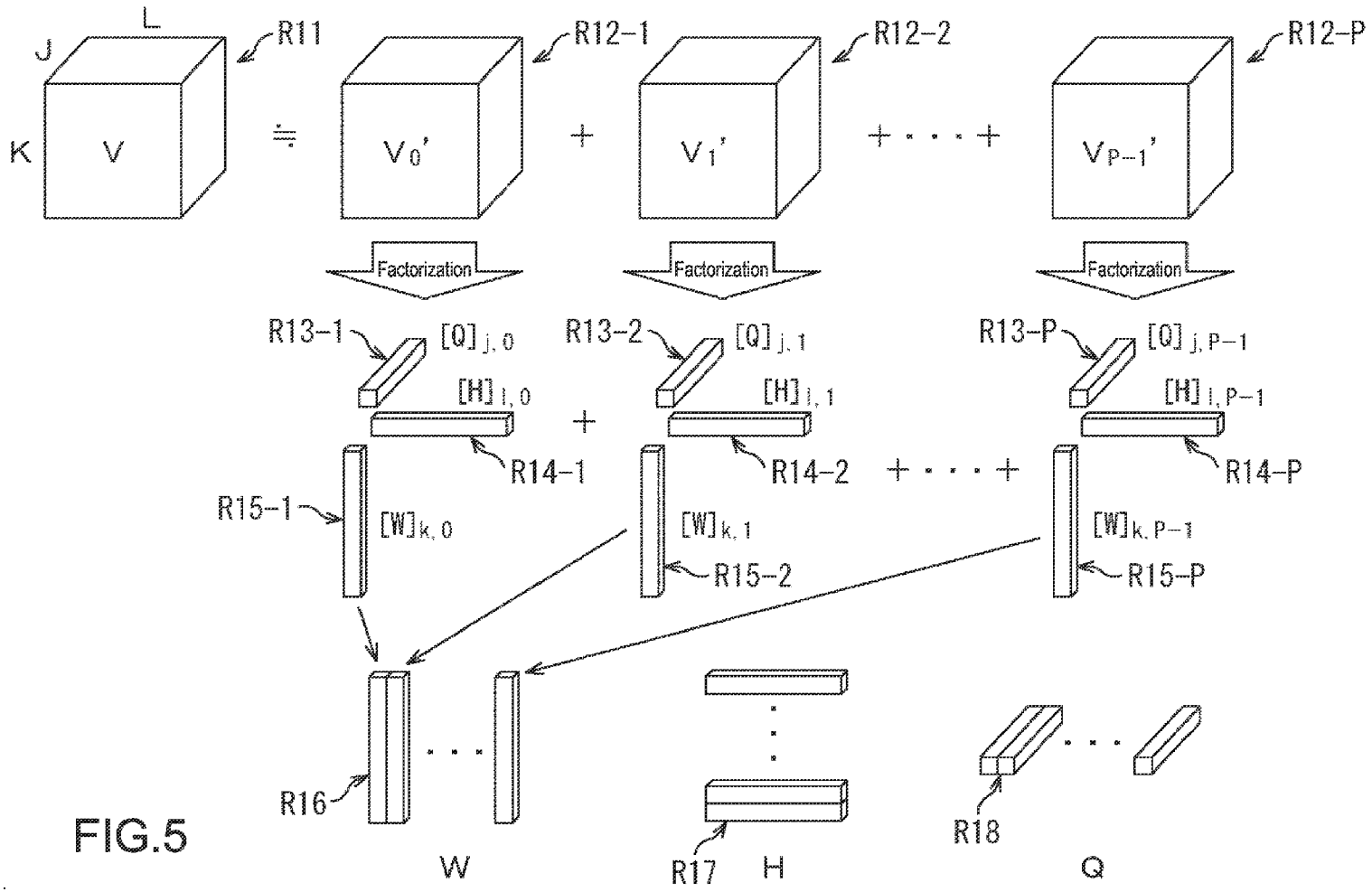
FIG. 5 is a diagram describing tensor factorization.

For example, it is assumed as shown in FIG. 5 that base spectrograms $V_0'$ to $V_{p-1}'$ indicated by arrows R12-1 to R12-P, respectively, are obtained when a three-dimensional tensor obtained by excluding an error tensor E is factorized into P base three-dimensional tensors from a non-negative spectrogram V indicated by an arrow R11.

The respective base spectrograms $V_p'$ (where $0 \le p \le P-1$), i.e., the above three-dimensional tensors $V_p'$ may be each expressed by a direct product of three vectors.

For example, the base spectrogram $V_0'$ may be expressed by a direct product of a vector $[Q]_{j,0}$ indicated by an arrow R13-1, a vector $[H]_{l,0}$ indicated by an arrow R14-1, and a vector $[W]_{k,0}$ indicated by an arrow R15-1.

The vector $[Q]_{j,0}$ is a column vector including J elements, J being the total number of channels, and the sum of the values of the respective J elements is one. The respective J elements of the vector $[Q]_{j,0}$ are components corresponding to respective channels indicated by a channel index j.

In addition, the vector $[H]_{l,0}$ is a row vector including L elements, L being the number of total time frames, and the respective L elements of the vector $[H]_{l,0}$ are components corresponding to respective time frames indicated by a time frame index l. Moreover, the vector $[W]_{k,0}$ is a column vector including K elements, K being the number of frequencies, and the respective K elements of the vector $[W]_{k,0}$ are components corresponding to frequencies indicated by a frequency index k.

The vectors $[Q]_{j,0}$, $[H]_{l,0}$, and $[W]_{k,0}$ express properties in the channel direction, the time direction, and the frequency direction of the base spectrogram $V_0'$, respectively.

Similarly, the base spectrogram $V_1'$ may be expressed by a direct product of a vector $[Q]_{j,1}$ indicated by an arrow R13-2, a vector $[H]_{l,1}$ indicated by an arrow R14-2, and a vector $[W]_{k,1}$ indicated by an arrow R15-2. In addition, the base spectrogram $V_{p-1}'$ may be expressed by a direct product of a vector $[Q]_{j,P-1}$ indicated by an arrow R13-P, a vector $[H]_{l,P-1}$ indicated by an arrow R14-P, and a vector $[W]_{k,P-1}$ indicated by an arrow R15-P.

Then, the three vectors corresponding to the three dimensions of the P base spectrograms $V_p'$ (where $0 \le p \le P-1$) are integrated together for each dimension to constitute the channel matrix Q, the frequency matrix W, and the time matrix H.

That is, a matrix including the vectors $[W]_{k,0}$ to $[W]_{k,P-1}$ expressing the properties in the frequency direction of the respective base spectrograms $V_p'$ is the frequency matrix W as indicated by an arrow R16 on a lower side in FIG. 5.

Similarly, a matrix including the vectors $[H]_{l,0}$ to $[H]_{l,P-1}$ expressing the properties in the time direction of the respective base spectrograms $V_p'$ is the time matrix H as indicated by an arrow R17. In addition, a matrix including the vectors $[Q]_{j,0}$ to $[Q]_{j,P-1}$ expressing the properties in the channel direction of the respective base spectrograms $V_p'$ is the channel matrix Q as indicated by an arrow R18.

By the properties of the non-negative tensor factorization (NTF), the respective P base spectrograms $V_p'$ learn how to express their unique properties in a sound source. Since all the elements are restricted to non-negative values by the non-negative tensor factorization, only the additive combinations of the base spectrograms $V_p'$ are allowed, which decreases the combination patterns and facilitates the separation with the unique properties in the sound source.

For example, it is assumed that sounds from a point sound source AS1 and a point sound source AS2 with two different types of properties are mixed together. As an example, it is assumed that the sound from the point sound source AS1 is a sound of a person and the sound from the point sound source AS2 is an engine sound of an automobile.

In this case, the two point sound sources are likely to appear in different base spectrograms $V_p'$. That is, for example, among the total P base spectrograms, r base spectrograms $V_{p1}'$ arranged in succession are allocated to the sound of the person as the first point sound source AS1 and P−r base spectrograms $V_{p2}'$ arranged in succession are allocated to the engine sound of the automobile as the second point sound source AS2.

Accordingly, by selecting a base index p in any range, it is possible to extract each point sound source to perform sound processing.

Here, the properties of the respective matrices of the channel matrix Q, the frequency matrix W, and the time matrix H will be further described.

The channel matrix Q expresses the properties in the channel direction of the non-negative spectrogram V. That is, it appears that the channel matrix Q indicates a contribution degree to the total J respective channels j of the P base spectrograms $V_p'$.

For example, it is assumed that the total number of channels J is two and a pseudo-multichannel input signal is a two-channel stereo signal. In addition, it is assumed that the element $[Q]_{:,p1}$ of the channel matrix Q where a base index p is p1 has a value of $[0.5, 0.5]^T$ and the element $[Q]_{:,p2}$ of the channel matrix Q where the base index p is p2 has a value of $[0.9, 0.1]^T$.

Here, in the value $[0.5, 0.5]^T$ of the element $[Q]_{:,p1}$ as a column vector, both the values of left and right channel are 0.5. Similarly, in the value $[0.9, 0.1]^T$ of the element $[Q]_{:,p2}$ as a column vector, the value of the left channel is 0.9 and the value of the right channel is 0.1.

When space including the values of the left and right channels is taken into consideration, the values of the components of the left and right channels of the element $[Q]_{:,p1}$ are the same. Therefore, since both the left and right channels are equally weighted, a sound source with the properties of a base spectrogram $V_{p1}'$ remotely exists.

On the other hand, since the value 0.9 of the component of the left channel is greater than the value 0.1 of the component of the right channel in the element $[Q]_{:,p2}$ and thus the left channel is unevenly weighted, it is indicated that a sound source with the properties of a base spectrogram $V_{p2}'$ exists at a position near the left channel.

Considering the fact that the point sound sources appear in the different base spectrograms $V_p'$ as described above, it may be said that the channel matrix Q indicates rough arrangement information on the respective point sound sources.

Figure 6:
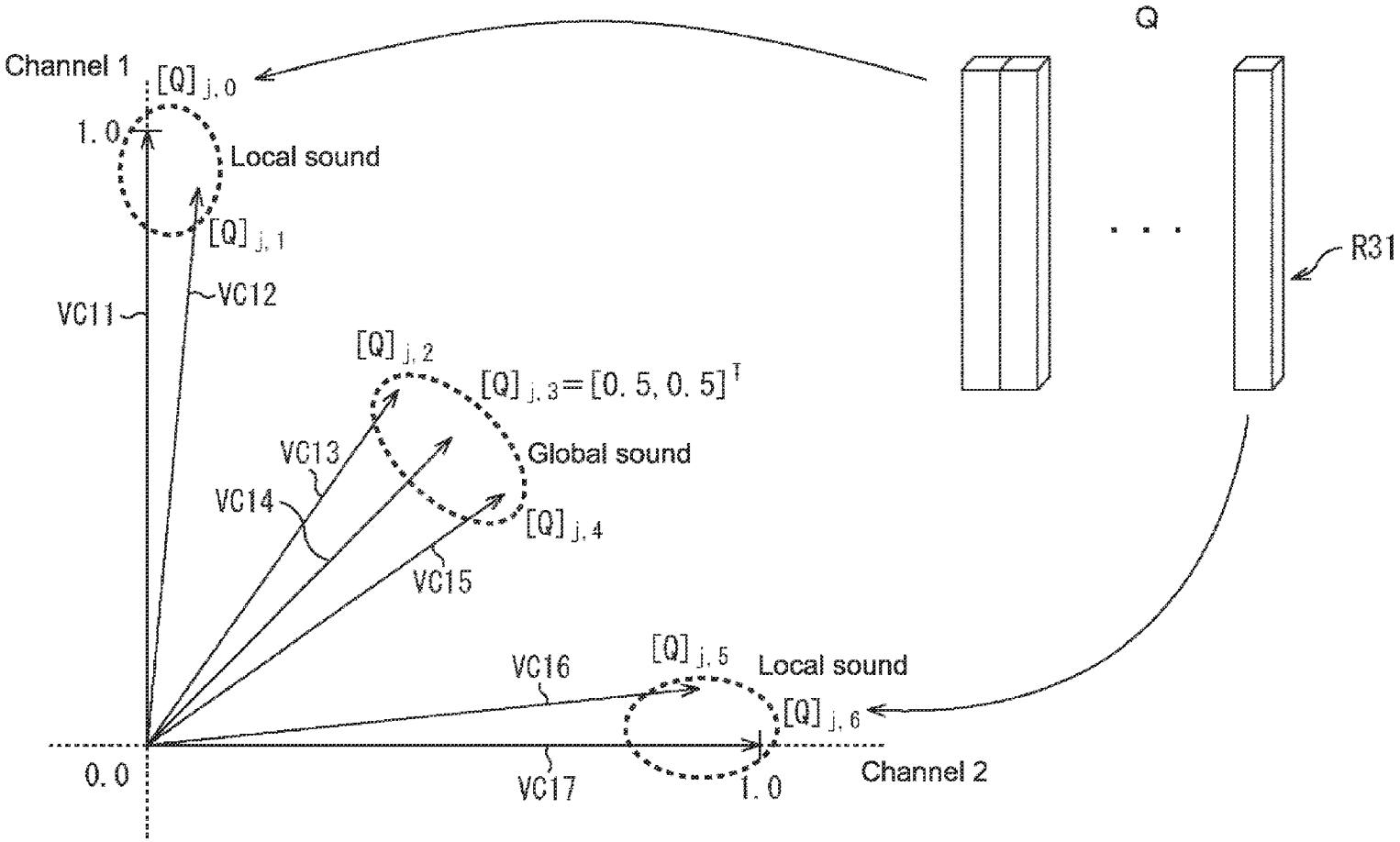
FIG. 6 is a diagram describing a channel matrix.

Here, FIG. 6 shows the relationship between the respective elements of the channel matrix Q when the total number of channels J is two and the number of bases P is seven. Note that in FIG. 6, vertical and horizontal axes indicate channels 1 and 2, respectively. In this example, the channel 1 is a left channel, and the channel 2 is a right channel.

For example, it is assumed that vectors VC11 to VC17 indicated by arrows are obtained when the channel matrix Q indicated by an arrow R31 is divided into the respective elements where the number of the bases P is seven. In this example, the vectors VC11 to VC17 correspond to elements $[Q]_{j,0}$ to $[Q]_{j,6}$, respectively. In addition, an element $[Q]_{j,3}$ has a value of $[0.5, 0.5]^T$, and the element $[Q]_{j,3}$ indicates the central direction between the axial direction of the channel 1 and the axial direction of the channel 2.

Since a global sound is a loud sound emitted from a sound source distant from a microphone, the contribution degree of the element $[Q]_{j,p}$ as the component of the global sound to the respective channels is likely to be almost even. On the other hand, since a local sound is a low sound emitted from a sound source near a microphone, the contribution degree of the element $[Q]_{j,p}$ as the component of the local sound to the respective channels is likely to be uneven.

For this reason, in this example, the elements where the base indexes p are two to four each having an almost even contribution degree to the left and right channels, i.e., the elements $[Q]_{j,2}$ to $[Q]_{j,4}$ are classified as the elements of the global sound. Then, by adding base spectrograms $V_2'$ to $V_4'$ reconstituted of corresponding three elements $[Q]_{:,p}$, $[W]_{:,p}$, and $[H]_{:,p}$, it is possible to extract the global sound.

On the other hand, the elements $[Q]_{j,0}$, $[Q]_{j,1}$, $[Q]_{j,5}$, and $[Q]_{j,6}$ each having an uneven contribution degree to the respective channels are the elements of the local sound. For example, since the elements $[Q]_{j,0}$ and $[Q]_{j,1}$ have a great contribution degree to the channel 1, they constitute the local sound emitted from a sound source positioned near a microphone by which the sound of the channel 1 is collected.

Next, the frequency matrix W will be described.

The frequency matrix W expresses the properties in the frequency direction of the non-negative spectrogram V. More specifically, the frequency matrix W expresses the contribution degree of the total P base spectrograms $V_p'$ to respective K frequency bins, i.e., the respective frequency characteristics of the respective base spectrograms $V_p'$.

For example, the base spectrogram $V_p'$ expressing the vowel of a sound has the matrix element $[W]_{:,p}$ indicating frequency characteristics in which low frequencies are enhanced, and the base spectrogram $V_p'$ expressing an affricate consonant has the element $[W]_{:,p}$ indicating frequency characteristics in which high frequencies are enhanced.

In addition, the time matrix H expresses the properties in the time direction of the non-negative spectrogram V. More specifically, the time matrix H indicates the contribution degree of the total P base spectrograms $V_p'$ to total L time frames, i.e., the respective time characteristics of the respective base spectrograms $V_p'$.

For example, the base spectrogram $V_p'$ expressing constant ambient noise has the matrix element $[H]_{:,p}$ indicating time characteristics in which the components of respective time frame indexes l have a constant value. In addition, the base spectrogram $V_p'$ expressing non-constant ambient noise has the matrix element $[H]_{:,p}$ indicating time characteristics in which a large value is generated instantaneously, i.e., the matrix element $[H]_{:,p}$ in which the component of a specific time frame index l has a large value.

Meanwhile, according to the non-negative tensor factorization (NTF), a cost function C is minimized for the channel matrix Q, the frequency matrix W, and the time matrix H by the calculation of the following formula (9) to optimize the channel matrix Q, the frequency matrix W, and the time matrix H.

$$\min_{Q,W,H} C(V \mid V') \stackrel{def}{=} \sum_{jkl} d_\beta(v_{jkl} \mid v'_{jkl}) + \delta S(W) + \varepsilon T(H) \tag{9}$$

-continued subject to $$Q, W, H \geq 0$$

Note that in the above formula (9), S(W) and T(H) express the constraint functions of the cost function C, respectively, with the frequency matrix W and the time matrix H as inputs. In addition, δ and ϵ express the weight of the constraint function S(W) of the frequency matrix W and the weight of the constraint function T(H) of the time matrix H, respectively. The addition of the constraint functions produces the effect of constraining the cost function and has an influence on separation. Generally, it is often to use sparse constraint, smooth constraint, or the like.

Moreover, in the above formula (9) $V_{jkl}$ expresses the element of the non-negative spectrogram V, and $v_{jkl}'$ expresses the predicted value of the element $v_{jkl}$. The element $v_{jkl}'$ is obtained by the calculation of the following formula (10). Note that in the following formula (10), $q_{jp}$ expresses an element specified by the channel index j and the base index p each constituting the channel matrix Q, i.e., the matrix element $[Q]_{j,p}$. Similarly, $w_{kp}$ expresses a matrix element $[W]_{k,p}$, and $h_{lp}$ expresses a matrix element $[H]_{l,p}$.

$$V'_{jkl} = \sum_{p=0}^{P-1} q_{jp} w_{kp} h_{lp} \tag{10}$$

A spectrogram including the element $v_{jkl}'$ calculated by the above formula (10) is an approximate spectrogram V' as the predicted value of the non-negative spectrogram V. In other words, the approximate spectrogram V' is an approximate value of the non-negative spectrogram V calculated from the base spectrogram $V_p'$ with the P bases.

Moreover, in the above formula (9), a β divergence $d_\beta$ is used as an index for measuring the distance between the non-negative spectrogram V and the approximate spectrogram V'. The β divergence is expressed by, for example, the following formula (11).

$$d_\beta(x \mid y) \stackrel{def}{=} \begin{cases} \frac{1}{\beta(\beta-1)}(x^\beta + (\beta-1)y^\beta - \beta x y^{\beta-1}) & \beta \notin \mathbb{R}\{0, 1\} \\ x\log\frac{x}{y} - x + y & \beta = 1 \\ \frac{x}{y} - \log\frac{x}{y} - 1 & \beta = 0 \end{cases} \tag{11}$$

That is, when β is neither one nor zero, the β divergence is calculated by the formula shown on the top side of the above formula (11). In addition, when β is one, the β divergence is calculated by the formula shown on the middle side of the above formula (11).

Moreover, when β is zero (Itakura-Saito distance), the β divergence is calculated by the formula shown on the bottom side of the above formula (11). In this case, the following formula (12) is calculated.

$$d_{\beta=0}(x \mid y) = \frac{x}{y} - \log\frac{x}{y} - 1 \tag{12}$$

In addition, the differential of a β divergence $d_{\beta=0}(x|y)$ where β=zero is shown in the following formula (13).

$$d'_{\beta=0}(x \mid y) = \frac{1}{y} - \frac{x}{y^2} \tag{13}$$

Accordingly, in the example of the above formula (9), a β divergence $D_0(V|V')$ is one shown in the following formula (14). In addition, the partial differentials of the channel matrix Q, the frequency matrix W, and the time matrix H are those shown in the following formulae (15) to (17), respectively. Note, however, that in the following formulae (14) to (17), a subtraction, a division, and a logarithmic computation are all calculated for each element.

$$D_0(V \mid V') = \sum_{jkl} d_{\beta=0}(v_{jkl} \mid v'_{jkl}) = \sum_{jkl}\left(\frac{v_{jkl}}{v'_{jkl}} - \log\frac{v_{jkl}}{v'_{jkl}} - 1\right) \tag{14}$$

$$\nabla_{q_{jp}} D_0(V \mid V') = \sum_{kl} w_{kp} h_{lp} d'_{\beta=0}(v_{jkl} \mid v'_{jkl}) \tag{15}$$

$$\nabla_{w_{kp}} D_0(V \mid V') = \sum_{jl} q_{jp} h_{lp} d'_{\beta=0}(v_{jkl} \mid v'_{jkl}) \tag{16}$$

$$\nabla_{h_{lp}} D_0(V \mid V') = \sum_{jk} q_{jp} w_{kp} d'_{\beta=0}(v_{jkl} \mid v'_{jkl}) \tag{17}$$

Subsequently, when the update formula of the non-negative tensor factorization (NTF) is expressed using parameters θ simultaneously expressing the channel matrix Q, the frequency matrix W, and the time matrix H, the following formula (18) is obtained. Note, however, that in the following formula (18), the symbol "·" expresses a multiplication for each element and a division is calculated for each element.

$$\theta \leftarrow \theta \cdot \frac{[\nabla_\theta D_0(V \mid V')]_-}{[\nabla_\theta D_0(V \mid V')]_+} \tag{18}$$

where $$\nabla_\theta D_0(V \mid V') = [\nabla_\theta D_0(V \mid V')]_+ - [\nabla_\theta D_0(V \mid V')]_-$$

Note that in the above formula (18), $[\nabla_\theta D_0(V|V')]_+$ and $[\nabla_\theta D_0(V|V')]_-$ express the positive and negative parts of a function $[\nabla_\theta D_0(V|V')]$, respectively.

Accordingly, the update formulae of the non-negative tensor factorization in a case in which the constraint function in the above formula (9) is not taken into consideration are those shown in the following formulae (19) to (21). Note, however, that in the following formulae (19) to (21), a factorial and a division are all calculated for each element.

$$Q \leftarrow Q \cdot \frac{\langle V/V'^2, W \circ H\rangle_{\{2,3\},\{1,2\}}}{\langle 1/V', W \circ H\rangle_{\{2,3\},\{1,2\}}} \tag{19}$$

$$W \leftarrow W \cdot \frac{\langle V/V'^2, Q \circ H\rangle_{\{1,3\},\{1,2\}}}{\langle 1/V', Q \circ H\rangle_{\{1,3\},\{1,2\}}} \tag{20}$$

-continued $$H \leftarrow H \cdot \frac{\langle V/V'^2, Q \circ W\rangle_{\{1,2\},\{1,2\}}}{\langle 1/V', Q \circ W\rangle_{\{1,2\},\{1,2\}}} \tag{21}$$

Note that in the above formulae (19) to (21), the symbol "○" expresses a direct product of a matrix. That is, when A is an $i_A \times P$ matrix and B is an $i_B \times P$ matrix, "A○B" expresses the three-dimensional tensor of $i_A \times i_B \times P$.

In addition, $\langle A, B\rangle_{\{C\},\{D\}}$ is called a shrinkage product of a tensor and expressed by the following formula (22). Note, however, that in the following formula (22), respective characters are not correlated with the symbols expressing the matrices or the like described above.

$$\langle A, B\rangle_{\{1,\ldots,M\},\{1,\ldots M\}} = \sum_{i_1=1}^{I_1} \cdots \sum_{i_1=1}^{I_M} a_{i_1 \ldots i_M, j_1 \ldots j_N} b_{i_1 \ldots i_M, k_1 \ldots k_P} \tag{22}$$

In the above cost function C, the constraint function S(W) of the frequency matrix W and the constraint function T(H) of the time matrix H are taken into consideration in addition to the β divergence $d_\beta$, and their influences on the cost function C are controlled by the weights δ and ϵ, respectively.

In this example, the constraint function T(H) is added such that the components of which the base indexes p of the time matrix H are close to each other retain a strong correlation and the components of which the base indexes p of the time matrix H are distant from each other retain a weak correlation. This is because sound sources with the same properties are intentionally collected together in a specific direction to a maximum extent when one point sound source is decomposed into some base spectrograms $V_p'$.

In addition, although the weights δ and ϵ as penalty control values are such that δ is zero and ϵ is 0.2 for example, the penalty control values may have other values. Note, however, that one point sound source may appear in a direction different from a specific direction depending on the values of the penalty control values. Therefore, it may be necessary to repeatedly perform an experiment to determine the values.

Moreover, the constraint functions S(W) and T(H) are, for example, those shown in the following formulae (23) and (24), respectively. In addition, functions $\nabla_w S(W)$ and $\nabla_H T(H)$ obtained by the partial differentials of the constraint functions S(W) and T(H), respectively, are those shown in the following formulae (25) and (26), respectively.

$$S(W)=0 \tag{23}$$

$$T(H)=|B\cdot(H^T H)|_1 \tag{24}$$

$$\nabla_W S(W)=0 \tag{25}$$

$$\nabla_H T(H)=2BH^T \tag{26}$$

Note that in the above formula (24), "·" expresses the multiplication of elements and "$|\cdot|_1$" expresses an L1 norm.

In addition, in the above formulae (24) and (26), B expresses a correlation control matrix with a size of P×P. Moreover, the diagonal component of the correlation control matrix B is set at zero, and the non-diagonal component of the correlation control matrix B is set at a value linearly close to one with a distance from the diagonal component.

If the correlation between the base indexes p distant from each other is strong when the covariance of the time matrix H is found and multiplied by the correlation control matrix B for each element, a greater value is added to the cost function C. On the other hand, if the correlation between the base indexes p close to each other is equally strong, a great value is not reflected on the cost function C. Therefore, the bases close to each other learn how to have similar properties.

In the example of the above formula (9), the following formulae (27) and (28) are obtained as the update formulae of the frequency matrices W and H, respectively, by the introduction of the constraint functions. Note that there is no change in the channel matrix Q. That is, the channel matrix Q is not updated.

$$W \leftarrow W \cdot \frac{\langle V/V'^2, Q \circ H\rangle_{\{1,3\},\{1,2\}} + \delta[\nabla_W S(W)]_-}{\langle 1/V', Q \circ H\rangle_{\{1,3\},\{1,2\}} + \delta[\nabla_W S(W)]_+} \tag{27}$$

$$H \leftarrow H \cdot \frac{\langle V/V'^2, Q \circ W\rangle_{\{1,2\},\{1,2\}} + \varepsilon[\nabla_H T(H)]_-}{\langle 1/V', Q \circ W\rangle_{\{1,2\},\{1,2\}} + \varepsilon[\nabla_H T(H)]_+} \tag{28}$$

As described above, the channel matrix Q is not updated, but only the frequency matrix W and the time matrix H are updated. Note that although the channel matrix Q, the frequency matrix W, and the time matrix H are initialized by random non-negative values, any value may be specified by a user.

Thus, the sound source factorization unit 23 minimizes the cost function C in the above formula (9) while updating the frequency matrix W and the time matrix H by the above formulae (27) and (28), respectively, to optimize the channel matrix Q, the frequency matrix W, and the time matrix H.

Then, the channel matrix Q, the frequency matrix W, and the time matrix H thus obtained are supplied from the sound source factorization unit 23 to the sound source selection unit 24.

(Sound Source Selection Unit)

Next, the sound source selection unit 24 will be described.

In the sound source selection unit 24, the channel matrix Q supplied from the sound source factorization unit 23 is used, and the P base spectrograms $V_p'$ are classified into a global sound group and a local sound group. That is, the respective base spectrograms $V_p'$ are classified into any of the global sound group and the local sound group.

Specifically, the sound source selection unit 24 calculates, for example, the following formula (29) to normalize the channel matrix Q.

$$[Q]_{j,p} = \frac{[Q]_{j,p}}{\sum_{j=0}^{J-1} [Q]_{j,p}} \tag{29}$$

Further, the sound source selection unit 24 calculates the following formula (30) for the normalized channel matrix Q, i.e., the element $[Q]_{j,p}$ for each P bases using a threshold $t_j$ to classify the base spectrograms $V_p'$, i.e., the bases p into groups. Specifically, the sound selection unit 24 regards the group of the bases P belonging to a global sound as a global sound group Z.

$$Z = \{p: \prod_j ([Q]_{j,p} \le t_j)\}(t_j\text{: threshold}) \tag{30}$$

For example, the threshold $t_j$ is set for each channel j, and a value (indicating a contribution degree to the channel j) indicated by the channel index j of the element $[Q]_{j,p}$ for each channel j is compared with the threshold $t_j$ for a prescribed base index p. When the result of the comparison shows that the value of $[Q]_{j,p}$ is the threshold $t_j$ or less for all the channels j, the bases p with the base index p belong to the global sound group Z.

Here, the threshold $t_j$ is set based on the relationship between the position of a sound source to be extracted and the position of a microphone M11 by which the sound of each channel is collected.

For example, when a global sound emitted from one or a plurality of remotely located sound sources is extracted, the sound sources and each microphone M11 are arranged so as to be separated from each other by a certain distance. Therefore, as described above, each value of the element $[Q]_{j,p}$ containing the component of the global sound in the channel matrix Q, i.e., a value indicating a contribution degree to each channel is likely to be almost even.

Accordingly, by setting the value of each channel j of the threshold $t_j$ at an almost even value with a certain size, it is possible to specify the bases p containing the component of the global sound. Specifically, when the total number of channels J is, for example, two, the threshold $t_j$ is set at $[0.9, 0.9]^T$.

For example, in the case shown in FIG. 6, each value of the element $[Q]_{:,3}$ in all the channels j is the threshold $t_j$ or less for the element $[Q]_{:,3}=[0.5, 0.5]^T$ of the channel matrix indicated by the vector VC14. Therefore, the base where p=3 is selected as one belonging to the global sound group Z.

Note that in order to find a local sound group Z' including all the local sounds, it may be only necessary to select the bases p not included in the global sound group Z.

In addition, in order to find a local sound group Z" including local sounds collected by a specific microphone M11, it may be only necessary to set the threshold $t_j$ at, for example, $[0.99, 0.01]^T$ or the like and treats the bases p, in which the value of $[Q]_{j,p}$ becomes the threshold $t_j$ or less in all the channels j, as those belong to the local sound group Z". In this example, it is possible to extract only a local sound where the channel j=zero.

As described above, in order to extract a local sound collected by only a specific microphone M11, it may be only necessary to set the threshold $t_j$ of a channel corresponding to the specific microphone M11 at a large value to some extent and set the thresholds $t_j$ of other channels at small values.

When the global sound group Z is obtained, the sound source selection unit 24 resynthesizes only the bases p belonging to the global sound group Z to generate a global spectrogram $V_Z'$.

Specifically, the sound source selection unit 24 extracts the components of the bases p belonging to the global sound group Z, i.e., the element $q_{jp}$ of the channel matrix Q, the element $w_{kp}$ of the frequency matrix W, and the element $h_{lp}$ of the time matrix H each having the base index p from the respective matrices. Then, the sound source selection unit 24 calculates the following formula (31) based on the extracted elements a $q_{jp}$, $w_{kp}$, and $h_{lp}$ to find an element $v_{z\{jkl\}}'$ of the global spectrogram $V_Z'$.

$$v'_{z\{jkl\}} = \sum_{p \in z} q_{jp} w_{kp} h_{lp} \tag{31}$$

Moreover, the sound source selection unit 24 generates an output complex spectrogram Y based on the global spectrogram $V_Z'$ obtained by synthesizing each element $v_{z\{jkl\}}'$, the approximate spectrogram V' found by the above formula (10), and the input complex spectrogram X supplied from the time frequency transformation unit 22.

Specifically, the sound source selection unit 24 calculates the following formula (32) to find the output complex spectrogram Y as the complex spectrogram of the global sound. Note that in the following formula (32), the symbol "·" expresses the multiplication of elements and a division is calculated for each element.

$$Y = \frac{V_z'}{V'} \cdot X \tag{32}$$

In the above formula (32), the ratio of the global spectrogram $V_Z'$ to the approximate spectrogram V' is multiplied by the input complex spectrogram X to calculate the output complex spectrogram Y. By the calculation, only the components of the global sound are extracted from the input complex spectrogram X to generate the output complex spectrogram Y.

The sound source selection unit 24 supplies the obtained output complex spectrogram Y, i.e., the respective output complex spectrums Y(j, k, l) constituting the output complex spectrogram Y to the frequency-time transformation unit 25.

(Frequency-Time Transformation Unit)

The frequency-time transformation unit 25 performs frequency-time transformation on the output complex spectrums Y(j, k, l) as frequency information supplied from the sound source selection unit 24 to generate a multichannel output signal y(j, t) to be output to a subsequent stage.

Note that although a description will be given of a case in which an IDFT (Inverse Discrete Fourier Transform) is used, it is also possible to use any transform so long as it performs transformation corresponding to the inverse transformation of the transformation performed by the time-frequency transformation unit 22.

Specifically, the frequency-time transformation unit 25 calculates the following formulae (33) and (34) based on the output complex spectrums Y(j, k, l) to calculate a multichannel output frame signal y'(j, n, l).

$$Y'(j,k,l) = \begin{cases} Y(j,k,l) & k = 0, \ldots, \frac{M}{2} \\ conj(Y(j, M-k, l)) & k = \frac{M}{2}+1, \ldots, M-1 \end{cases} \tag{33}$$

$$y'(j,n,l) = \frac{1}{M}\sum_{k=0}^{M-1} Y'(j,k,l) \times \exp\left(j2\pi\frac{n \times k}{M}\right) \tag{34}$$

Then, the frequency-time transformation unit 25 multiplies the obtained multichannel output frame signal y'(j, n, l) by the window function $w_{syn}(n)$ shown in the following formula (35) and performs the overlap addition shown in the following formula (36) to synthesize frames.

$$W_{syn}(n) = \begin{cases} \left(0.5 - 0.5 \times \cos\left(2\pi\frac{n}{N}\right)\right)^{0.5} & n = 0, \ldots, N-1 \\ 0 & n = N, \ldots, M-1 \end{cases} \tag{35}$$

$$y^{curr}(j, n + l \times N) = y'(j,n,l) \times w_{syn}(n) + y^{prev}(j, n + l \times N) \tag{36}$$

In the overlap addition of the above formula (36), the multichannel output frame signal y'(j, n, l) multiplied by the window function $w_{syn}(n)$ is added to a multichannel output signal $y^{prev}(j, n+1\times N)$ as a multichannel output signal y(j, n+1×N) before being updated. Then, a resulting multichannel output signal $y^{curr}(j, n+1\times N)$ is used as a new updated multichannel output signal y(j, n+1×N). Thus, the multichannel output frame signal of each frame is added to the multichannel output signal y(j, n+1×N) to obtain a final multichannel output signal y(j, n+1×N).

The frequency-time transformation unit 25 outputs the finally-obtained multichannel output signal y(j, n+1×N) to the subsequent stage as the multichannel output signal y(j, t). That is, the multichannel output signal y(j, t) is output from the global sound extraction apparatus 11.

Note that in the above formula (35), the same window function as the window function $w_{ana}(n)$ used by the time-frequency transformation unit 22 is used as the window function $w_{syn}(n)$. However, when other windows such as a hamming window are used as the window function used by the time-frequency transformation unit 22, a rectangular window may be used as the window function $w_{syn}(n)$.

(Description of Sound Source Extraction Processing)

Figure 7:
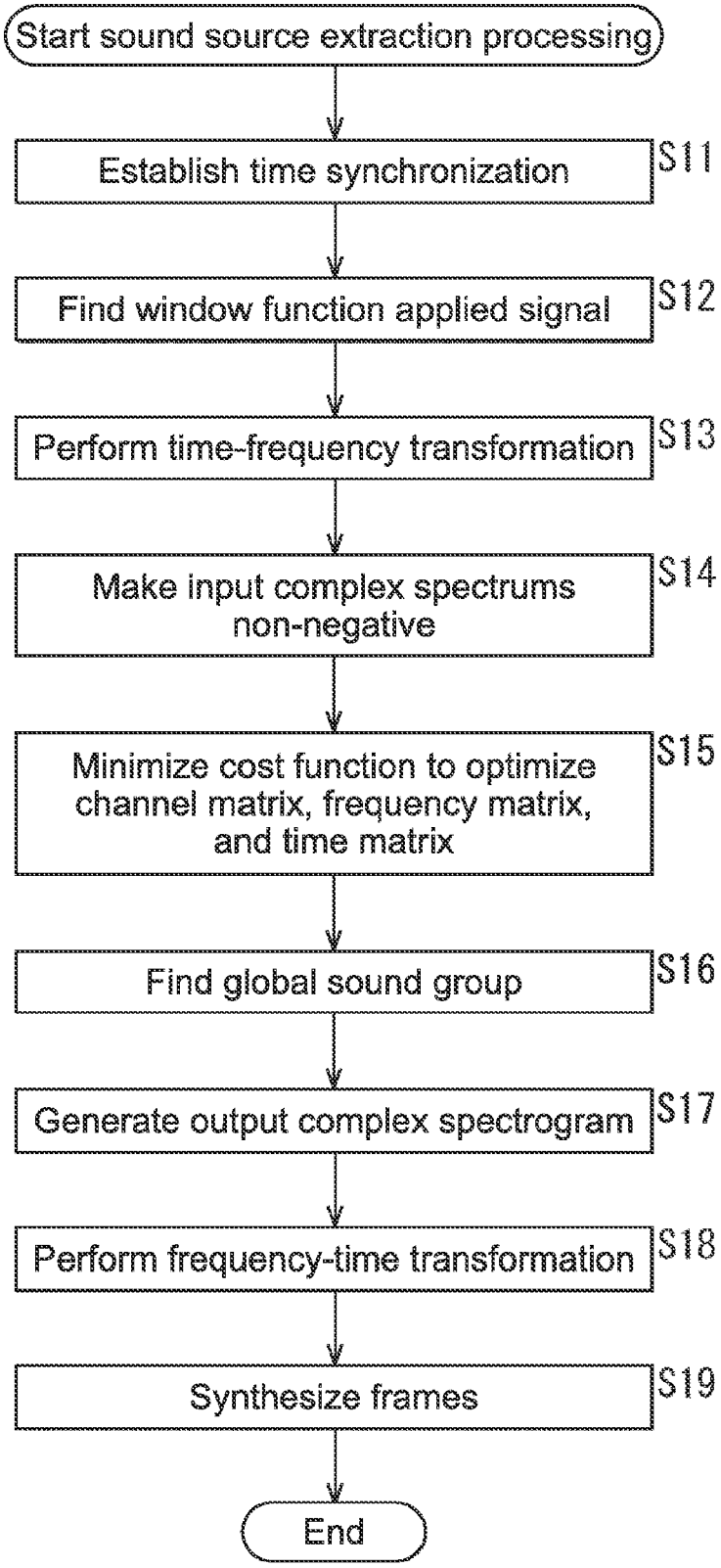
FIG. 7 is a flowchart describing sound source extraction processing.

Next, a description will be given of sound source extraction processing by the global sound extraction apparatus 11 with reference to a flowchart in FIG. 7. The sound source extraction processing is started when input signals $S_j(t)$ are supplied from a plurality of microphones M11 to the signal synchronization unit 21.

In step S11, the signal synchronization unit 21 establishes the time synchronization of the supplied input signals $S_j(t)$.

That is, the signal synchronization unit 21 calculates above formula (1) for each target input signal $S_j(t)$ among the input signals $S_j(t)$ to find a cross correlation value $R_j(\gamma)$. In addition, the signal synchronization unit 21 calculates the above formulae (2) and (3) based on the obtained cross correlation value $R_j(\gamma)$ to find a pseudo-multichannel input signal x(j, t) and supplies the same to the time-frequency transformation unit 22.

In step S12, the time-frequency transformation unit 22 performs time frame division on the pseudo-multichannel input signal x(j, t) supplied from the signal synchronization unit 21 and multiplies a resulting pseudo-multichannel input frame signal by a window function to find a window function applied signal $x_w(j, n, l)$. For example, the above formula (4) is calculated to find the window function applied signal $x_w(j, n, l)$.

In step S13, the time-frequency transformation unit 22 performs time-frequency transformation on the window function applied signal $x_w(j, n, l)$ to find input complex spectrums X(j, k, l) and supplies an input complex spectrogram X including the input complex spectrums to the sound source selection unit 24. For example, the above formulae (6) and (7) are calculated to find the input complex spectrums X(j, k, l).

In step S14, the time-frequency transformation unit 22 makes the input complex spectrums X(j, k, l) non-negative and supplies a non-negative spectrogram V including the obtained non-negative spectrums V(j, k, l) to the sound source factorization unit 23. For example, the above formula (8) is calculated to find the non-negative spectrums V(j, k, l).

In step S15, the sound source factorization unit 23 minimizes a cost function C based on the non-negative spectrogram V supplied from the time-frequency transformation unit 22 to optimize a channel matrix Q, a frequency matrix W, and a time matrix H.

For example, the sound source factorization unit 23 minimizes the cost function C shown in the above formula (9) while updating the matrices according to the update formulae shown in the above formulae (27) and (28) to find the channel matrix Q, the frequency matrix W, and the time matrix H by tensor factorization.

Then, the sound source factorization unit 23 supplies the channel matrix Q, the frequency matrix W, and the time matrix H thus obtained to the sound source selection unit 24.

In step S16, the sound source selection unit 24 finds a global sound group Z including bases belonging to a global sound based on the channel matrix Q supplied from the sound source factorization unit 23.

Specifically, the sound source selection unit 24 calculates the above formula (29) to normalize the channel matrix Q and further calculates the above formula (30) to compare an element $[Q]_{j,p}$ with a threshold $t_j$ and find the global sound group Z.

In step S17, the sound source selection unit 24 generates an output complex spectrogram Y based on the channel matrix Q, the frequency matrix W, and the time matrix H supplied from the sound source factorization unit 23 and the input complex spectrogram X supplied from the time-frequency transformation unit 22.

Specifically, the sound source selection unit 24 calculates the above formula (31) for the bases p belonging to the global sound group Z to find a global spectrogram $V_Z'$ and calculates the above formula (10) based on the channel matrix Q, the frequency matrix W, and the time matrix H to find an approximate spectrogram V'.

Moreover, the sound source selection unit 24 calculates the above formula (32) based on the global spectrogram $V_Z'$, the approximate spectrogram V', and the input complex spectrogram X and extracts the components of the global sound from the input complex spectrogram X to generate the output complex spectrogram Y. Then, the sound source selection unit 24 supplies the obtained output complex spectrogram Y to the frequency-time transformation unit 25.

In step S18, the frequency-time transformation unit 25 performs frequency-time transformation on the output complex spectrogram Y supplied from the sound source selection unit 24. For example, the above formulae (33) and (34) are calculated to find a multichannel output frame signal y'(j, n, l).

In step S19, the frequency-time transformation unit 25 multiplies the multichannel output frame signal y'(j, n, l) by a window function for overlap addition to synthesize frames and outputs a resulting multichannel output signal y(j, t) to terminate the sound source extraction processing. For example, the above formula (36) is calculated to find the multichannel output signal.

Thus, the global sound extraction apparatus 11 factorizes a non-negative spectrogram into a channel matrix Q, a frequency matrix W, and a time matrix H by a tensor factorization. Further, the global sound extraction apparatus 11 extracts components specified by the comparison between the channel matrix Q and the threshold as the components of a global sound, i.e., a sound emitted from a remote location from the channel matrix Q, the frequency matrix W, and the time matrix H to generate an output complex spectrogram Y.

As described above, sound source components from a desired sound source are specified using a channel matrix Q obtained by the tensor factorization of a non-negative spectrogram, whereby sound source separation is made possible more easily and reliably without a special device. Particularly, according to the global sound extraction apparatus 11, an appropriate threshold $t_j$ is compared with a channel matrix Q, whereby the extraction of a sound from a desired sound source such as a global sound from one or a plurality of sound sources and a local sound from a specific sound source is made possible with high accuracy.

Meanwhile, the above series of processing may be executed not only by hardware but also by software. In a case in which the series of processing is executed by software, a program constituting the software is installed in a computer. Here, examples of the computer include a computer incorporated in dedicated hardware and a general-purpose personal computer capable of executing various functions with the installation of various programs.

Figure 8:
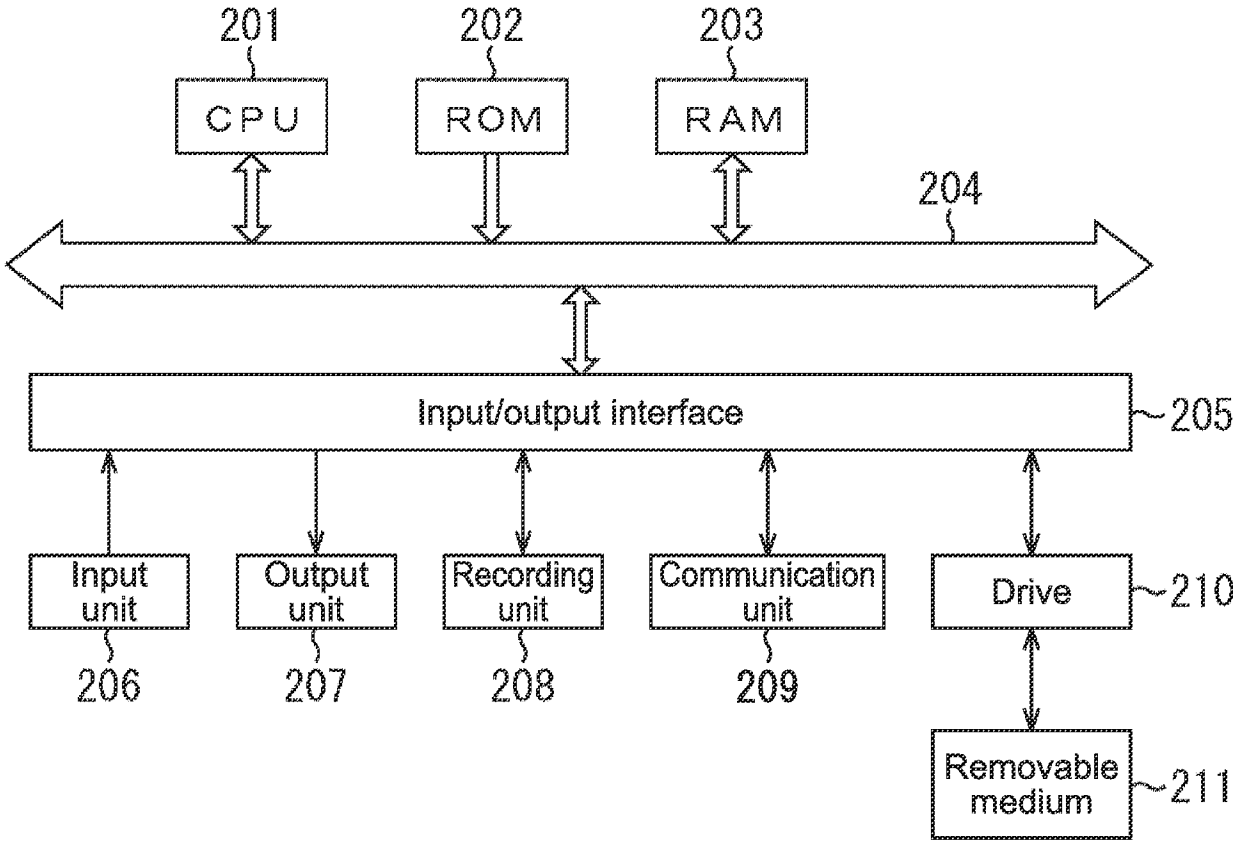
FIG. 8 is a diagram showing a configuration example of a computer.

FIG. 8 is a block diagram showing a hardware configuration example of a computer that executes the above series of processing with a program.

In the computer, a CPU (Central Processing Unit) 201, a ROM (Read Only Memory) 202, and a RAM (Random Access Memory) 203 are connected to each other via a bus 204.

The bus 204 is also connected to an input/output interface 205. The input/output interface 205 is connected to an input unit 206, an output unit 207, a recording unit 208, a communication unit 209, and a drive 210.

The input unit 206 includes a keyboard, a mouse, a microphone, an imaging device, or the like. The output unit 207 includes a display, a speaker, or the like. The recording unit 208 includes a hard disk, a non-volatile memory, or the like. The communication unit 209 includes a network interface or the like. The drive 210 drives a removable medium 211 such as a magnetic disk, an optical disk, a magneto-optical disk, and a semiconductor memory.

In the computer thus configured, the CPU 201 loads, for example, a program recorded on the recording unit 208 into the RAM 203 via the input/output interface 205 and the bus 204 to execute the above series of processing.

The program to be executed by the computer (CPU 201) may be provided in a state of being recorded on the removable medium 211 as a package medium or the like. In addition, the program may be provided via a wired or wireless transmission medium such as a local area network, the Internet, and digital satellite broadcasting.

In the computer, the program may be installed in the recording unit 208 via the input/output interface 205 when the removable medium 211 is mounted on the drive 210. In addition, the program may be received by the communication unit 209 via a wired or wireless transmission medium and installed in the recording unit 208. Besides, the program may be installed in the ROM 202 or the recording unit 208 in advance.

Note that the program to be executed by the computer may be a program that executes processing chronologically along the order described herein or may be a program that executes processing in parallel or at a necessary timing such as when being invoked.

Further, the embodiment of the present technology is not limited to the above embodiment but may be modified in various ways without departing from the spirit of the present technology.

For example, the present technology may employ the configuration of cloud computing in which one function is shared and processed cooperatively by a plurality of apparatuses via a network.

In addition, the respective steps described in the above flowchart may be executed not only by one apparatus or may be shared and executed by a plurality of apparatuses.

Moreover, when one step includes a plurality of processing, the plurality of processing included in the one step may be executed by one apparatus or may be shared and executed by a plurality of apparatuses.

Furthermore, the present technology may also employ the following configurations.

(1) A sound processing apparatus, including:

a factorization unit configured to factorize frequency information obtained by performing time-frequency transformation on sound signals of a plurality of channels into a channel matrix expressing properties in a channel direction, a frequency matrix expressing properties in a frequency direction, and a time matrix expressing properties in a time direction; and an extraction unit configured to compare the channel matrix with a threshold and extract components specified by a result of the comparison from the channel matrix, the frequency matrix, and the time matrix to generate the frequency information on a sound from a desired sound source.

(2) The sound processing apparatus according to (1), in which the extraction unit is configured to generate the frequency information on the sound from the sound source based on the frequency information obtained by the time-frequency transformation, the channel matrix, the frequency matrix, and the time matrix.

(3) The sound processing apparatus according to (1) or (2), in which the threshold is set based on a relationship between a position of the sound source and a position of a sound collection unit configured to collect sounds of the sound signals of the respective channels.

(4) The sound processing apparatus according to any one of (1) to (3), in which the threshold is set for each of the channels.

(5) The sound processing apparatus according to any one of (1) to (4), further including a signal synchronization unit configured to bring signals of a plurality of sounds collected by different devices into synchronization with each other to generate the sound signals of the plurality of channels.

(6) The sound processing apparatus according to any one of (1) to (5), in which the factorization unit is configured to assume the frequency information as a three-dimensional tensor with a channel, a frequency, and a time frame as respective dimensions and factorize the frequency information into the channel matrix, the frequency matrix, and the time matrix by tensor factorization.

(7) The sound processing apparatus according to (6), in which the tensor factorization is non-negative tensor factorization.

(8) The sound processing apparatus according to any one of (1) to (7), further including a frequency-time transformation unit configured to perform frequency-time transformation on the frequency information on the sound from the sound source obtained by the extraction unit to generate a sound signal of the plurality of channels.

(9) The sound processing apparatus according to any one of (1) to (8), in which the extraction unit is configured to generate the frequency information containing sound components from one of the desired sound source and a plurality of the desired sound sources.

What is claimed is:

1. A sound processing apparatus, comprising:

factorization circuitry configured to factorize frequency information obtained by performing time-frequency transformation on sound signals of a plurality of channels into a channel matrix expressing properties in a channel direction, a frequency matrix expressing properties in a frequency direction, and a time matrix expressing properties in a time direction; and extraction circuitry configured to compare the channel matrix with a threshold and extract components specified by a result of the comparison from the channel matrix, the frequency matrix, and the time matrix to generate the frequency information on a sound from a desired sound source.

2. The sound processing apparatus according to claim 1, wherein the extraction circuitry is configured to generate the frequency information on the sound from the sound source based on the frequency information obtained by the time-frequency transformation, the channel matrix, the frequency matrix, and the time matrix.

3. The sound processing apparatus according to claim 1, wherein the threshold is set based on a relationship between a position of the sound source and a position of a sound collection unit configured to collect sounds of the sound signals of the respective channels.

4. The sound processing apparatus according to claim 1, wherein the threshold is set for each of the channels.

5. The sound processing apparatus according to claim 1, further comprising signal synchronization circuitry configured to bring signals of a plurality of sounds collected by different devices into synchronization with each other to generate the sound signals of the plurality of channels.

6. The sound processing apparatus according to claim 1, wherein the factorization circuitry is configured to assume the frequency information as a three-dimensional tensor with a channel, a frequency, and a time frame as respective dimensions and factorize the frequency information into the channel matrix, the frequency matrix, and the time matrix by tensor factorization.

7. The sound processing apparatus according to claim 6, wherein the tensor factorization is non-negative tensor factorization.

8. The sound processing apparatus according to claim 1, further comprising frequency-time transformation circuitry configured to perform frequency-time transformation on the frequency information on the sound from the sound source obtained by the extraction to generate a sound signal of the plurality of channels.

9. The sound processing apparatus according to claim 1, wherein the extraction circuitry is configured to generate the frequency information containing sound components from one of the desired sound source and a plurality of the desired sound sources.

10. A sound processing method, comprising:

factorizing frequency information obtained by performing time-frequency transformation on sound signals of a plurality of channels into a channel matrix expressing properties in a channel direction, a frequency matrix expressing properties in a frequency direction, and a time matrix expressing properties in a time direction; and comparing the channel matrix with a threshold and extracting components specified by a result of the comparison from the channel matrix, the frequency matrix, and the time matrix to generate the frequency information on a sound from a desired sound source.

11. A non-transitory computer-readable medium encoded with instructions that, when executed by a computer, cause the computer to execute processing including:

factorizing frequency information obtained by performing time-frequency transformation on sound signals of a plurality of channels into a channel matrix expressing properties in a channel direction, a frequency matrix expressing properties in a frequency direction, and a time matrix expressing properties in a time direction; and comparing the channel matrix with a threshold and extracting components specified by a result of the comparison from the channel matrix, the frequency matrix, and the time matrix to generate the frequency information on a sound from a desired sound source.

12. The sound processing apparatus of claim 1, wherein the factorization circuitry and extraction circuitry comprise a programmed computer.

* * * * *